US005219085A

United States Patent [19]

Craft et al.

[11] Patent Number: 5,219,085

[45] Date of Patent: Jun. 15, 1993

[54] DOMED LID FOR REFUSE CONTAINER

[75] Inventors: Charles W. Craft, Apple Creek; Stacy L. Wolff, Akron, both of Ohio

[73] Assignee: Rubbermaid Incorporated, Wooster, Ohio

[21] Appl. No.: 916,273

[22] Filed: Jul. 21, 1992

[51] Int. Cl.[5] ..... B65D 43/14

[52] U.S. Cl. ..... 220/252; 220/254; 220/343; 220/908

[58] Field of Search ..... 220/252, 254, 334, 337, 220/338, 343, 908

[56] References Cited

U.S. PATENT DOCUMENTS

| | | | |
|---|---|---|---|
| D. 217,498 | 5/1970 | Dilyard . | |
| D. 218,359 | 8/1970 | Marsh . | |
| D. 223,956 | 6/1972 | Kenerson . | |
| D. 229,279 | 11/1973 | Kay et al. . | |
| D. 233,127 | 10/1974 | Karn . | |
| D. 234,288 | 2/1975 | Kay et al. . | |
| D. 271,248 | 11/1983 | Maza et al. . | |
| D. 276,753 | 12/1984 | Maza et al. . | |
| D. 280,857 | 10/1985 | Fuller et al. . | |
| D. 281,111 | 10/1985 | McClelland . | |
| D. 292,638 | 11/1987 | Carville . | |
| D. 293,843 | 1/1988 | Kroll . | |
| D. 312,523 | 11/1990 | Delmerico . | |
| D. 321,576 | 11/1991 | Hradisky . | |
| D. 323,912 | 2/1992 | Delmerico . | |
| D. 323,914 | 2/1992 | Doxey et al. . | |
| D. 326,342 | 5/1992 | Doxey et al. . | |
| D. 326,754 | 6/1992 | Hradisky . | |
| 1,333,051 | 3/1920 | Young | 220/252 |
| 1,680,962 | 8/1928 | Voshardt | 220/252 |
| 3,219,227 | 11/1965 | Deisner | 220/908 |
| 3,904,218 | 9/1975 | Kostie . | |

OTHER PUBLICATIONS

Pp. 6, 7, 10 and 11, Trash Containers, Tucker Housewares, 25 Tucker Drive, Leominster, MA 01469. It is believed that the product depicted herein has been on sale for more than one (1) year prior to the application date of the this instant application.

Catalog Page, Trash Containers, Placewares, 351 Congress Street, Boston, MA 02210. Publication date 1990.

P. 5, Trash Container, Continental Manufacturing Company, 123 Byassee Drive, Hazelwood, MD 63042. Publication date 1987.

Catalog Page, Trash Containers, Polder, Inc. 200 Central Park Avenue, P.O. Box 456, Hartsdale, NY 10530. Publication date Jan. 1, 1991.

Sell Sheet, Trash Containers, Contico Manufacturing Company, A Division of Contico International, 1101 Warson Road, St. Louis, MO 63132. Publication date 1987.

(List continued on next page.)

*Primary Examiner*—Stephen P. Garbe
*Assistant Examiner*—Nova Stucker
*Attorney, Agent, or Firm*—Richard B. O'Planick; Lisa B. Riedesel

[57] ABSTRACT

A domed lid for a waste receptacle is disclosed and comprises a domed external surface (4) and a frontal recess (12) formed therein. A door (20) is pivotally mounted within the recess and has a central domed surface (34) surrounded by an edge flange border (36). A raised ridge (44) extends about the door periphery, and defines a channel with the door surface (34) positioned to collect water from sides of the lid (14,16) and direct the collected water downward over a radiused lower recess sidewall (18) and there to a lower rim of the lid. The lid further comprised spring members (30) which bias the door flange (36) against inward lid surfaces defining the recess, further deterring the entry of water around the door and into the interior of the lid. The shape of the recess and door further enable the lid to interstack with like-configured lids for efficiency in shipping and display at retail.

24 Claims, 14 Drawing Sheets

OTHER PUBLICATIONS

P. 4, Trash Containers, Contico Manufacturing Company, A Division of Contico International, 1101 Warson Road, St. Louis, MO 63132. Publication date 1987.

Sell Sheet, Trash Containers, Contico Manufacturing Company, A Division of Contico International, 1101 Warson Road, St. Louis, MO 63132. Publication date 1987.

Pp. 5, 11 and 17, Trash Containers, Curver Takkebysters 75, Postbus 6810, 4802 HV Breda, Publication date 1991.

P. 2, Trash Containers, F. H. Lawson Co., 801 Evan Street, Cincinnati, Ohio 45204. Publication date 1987.

P. 9, Trash Container, Continental Manufacturing Company, 123 Byassee Drive, Hazelwood, MD 63042. Publication date 1987.

P. 67, Trash Containers, Iwasaki Industry Inc. No. 26, Showa Kogyo Danchi, 1216-5, Nukatabe Kita-machi, Yamato, Koruyama, Nara, 63 9-11 Japan. It is believed that the product depicted herein has been on sale for more than one (1) year prior to the application date of the this insttant application.

Pp. 28 and 29, Trash Containers, Rubbermaid Incorporated, Housewares Products Division, 1147 Akron Road, Wooster, Ohio 44691. Publication date 1990.

Catalog Page, Diaper Pail, The Little Tikes Company, 2180 Barlow Road, Hudson, Ohio 44236. Publication date 1989.

Pp. 6, 9, 10, 18 and 21, Trash Containers, Rubbermaid Commerical Products Inc., 3124 Valley Avenue, Winchester, VA 22601. Publication date 1991.

DOMED LID FOR REFUSE CONTAINER

BACKGROUND OF THE INVENTION

1. Field of the Invention

The present invention relates to lids for refuse containers of the general type having a swinging lid door. More specifically, the refuse container lid is of a domed shape and has a lower shape and dimension suited to fit over the upper rim of a receptacle.

2. The Prior Art

Refuse containers having lids are common commercial and household items. Typically, such containers comprise a receptacle and a lid component adapted to fit over the upper rim of the receptacle.

Refuse containers are frequently used out of doors where they are exposed to the elements and in particular rain. In order to make the refuse container resistant to rain water entering the receptacle and its contents, specialized lid configurations have been developed and commercially sold.

In one such lid configuration, a lid is provided with a domed external shape in order to direct rain water thereover to the outside of the receptacle. A recess is formed in a forward portion of the domed lid and terminates at an inward vertical opening. To access the receptacle, a pivotal door is vertically mounted to the domed lid, within the recess, and swings inward and outward to open and close the lid opening. The lid door, being mounted in a vertical orientation, intersects the floor of the recess at a right angle. Spring biased, the lid, once released, swings back into its vertical orientation to close off the lid opening.

The lid door is provided with flanges along its perimeter edge, which abut against internal surfaces defining the lid opening. The pivot spring serves to bias those flanges against the internal surfaces, whereby deterring the entry of rain water around the lid door. However, because the door is vertical and the seal created by the flanges is imperfect, such lids still admit more than a satisfactory level of rain water into the receptacle. Rain can run down the face of the lid door, and can also run down the surfaces of the lid which define the recess, and gain access to the internal receptacle by seeping between the edges of the door and the lid.

A further shortcoming to conventionally configured domed lid configurations results from the vertically oriented swing door. The door and the floor of the recess creates a right angled protrusion into the interior of the lid which prevents multiple lids from being stacked within each other. This shortcoming adds significantly to the shipping costs of the lids and also makes them more inconvenient to display at point of purchase.

SUMMARY OF THE INVENTION

The present invention overcomes the above deficiencies in the prior art by providing a domed lid for a waste receptacle having superior rain water deterrence and which can be stacked in the inverted condition for efficiencies in shipment and point of sale display. The lid is provided with a domed external surface and a frontal recess formed therein, the recess being defined by top and lateral sidewalls and an outwardly concave lower sidewall which terminate at an inward opening. A door is positioned within the recess and pivots inward and back to selectively open and close the opening.

The door, pursuant to the present invention, has a central domed surface, following generally the domed external contour of the lid body. The door further provides edge flange portions bordering top, lateral and bottom door sides which are spring biased against correspondingly located internal surfaces of the lid which surround the opening. A ridge is formed along lateral and top sides of the door between the edge flanges and the domed central lid portion, and intersect with the domed central lid portion to create a water diverting channel which circumnavigates the perimeter of the lid to a forward lid end. Because of the domed shape of the door, the ends of the water diverting channel and the leading edge of the domed central lid portion are made to overhang the recess lower sidewall. The lateral recess side walls are formed to overhang the ridge along lateral sides of the door and drain into the water diverting channel. Along the top of the door, the top recess sidewall is vertically aligned against the top edge flange of the door and likewise drains into the water diverting channel.

Hence, rain water which strikes the body of the lid is channeled by the dome to a lower edge of the lid and does not invade the internal contents of the receptacle on which the lid rests. Rain water which strikes the domed door of the lid is channeled over the concave lower recess sidewall to the lower lid edge as well. Finally, rain water which strikes the sidewalls surrounding the door recess top and lateral sides is channeled into the water diverting channel surrounding the door, discharged over the bottom recess sidewall and thence to the lower lid edge. Coupled with the water deterring biased seal of the door edge flanges against internal surfaces of the lid, the subject invention provides structural protection from rain water invasion into the interior of the receptacle.

In addition, the domed door and the opening which is into the domed external lid surface produce no protrusion within the interior of the lid which might interfere with multiple lids nesting within one another. The result is economies in shipping the lids and displaying the lids at retail.

Accordingly, it is an objective of the subject invention to provide a lid for a waste receptacle having improved rain water diverting structure.

A further objective of the subject invention is to provide a waste receptacle lid door which deters the entry of rainwater around its edges and into the receptacle.

Still a further objective is to provide a waste receptacle lid door which captures rain water from surrounding lid portions and channels the collected water off the lid.

Yet a further objective is to provide a waste receptacle lid having a pivotal door which is spring biased to abut against internal lid surfaces, further deterring the entry of rain water into the interior of the lid.

Another objective is to provide a waste receptacle domed lid which can be nested with other lids.

A further objective is to provide a waste receptacle domed lid having a pivotal door, which is comprised of relatively few component parts.

A still further objective is to provide a waste receptacle domed lid having a pivotal door which is conventionally moldable from commercially available plastics material, and which can be readily and economically assembled.

These, and other objectives which will be apparent to those skilled in the art, are achieved by a preferred embodiment which is described in detail below and which is illustrated by the accompanying drawings.

BRIEF DESCRIPTION OF THE ACCOMPANYING DRAWINGS

Figure 5:
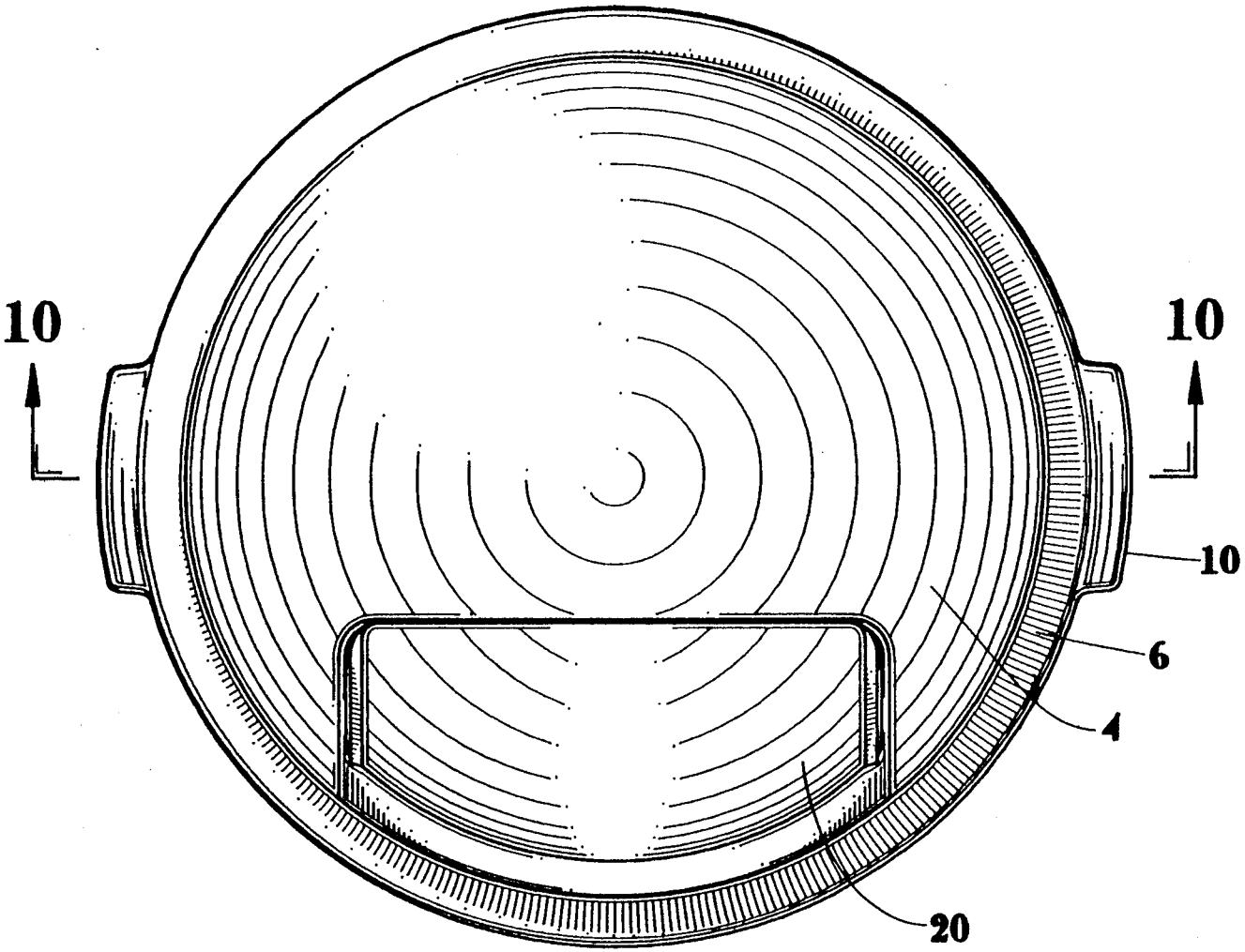

FIG. 5 a top plan view of the lid.

Figure 6:
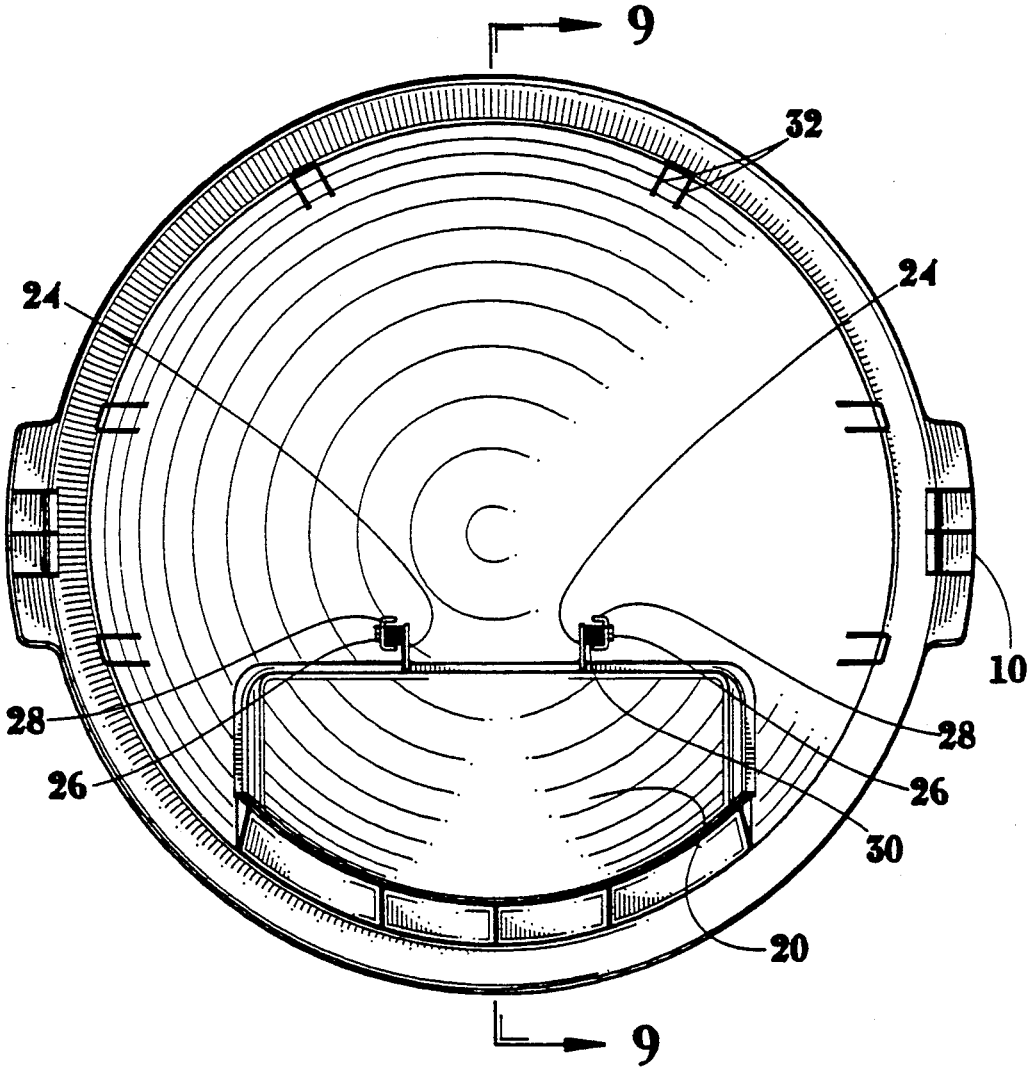

FIG. 6 is a bottom plan view of the lid.

Figure 7:
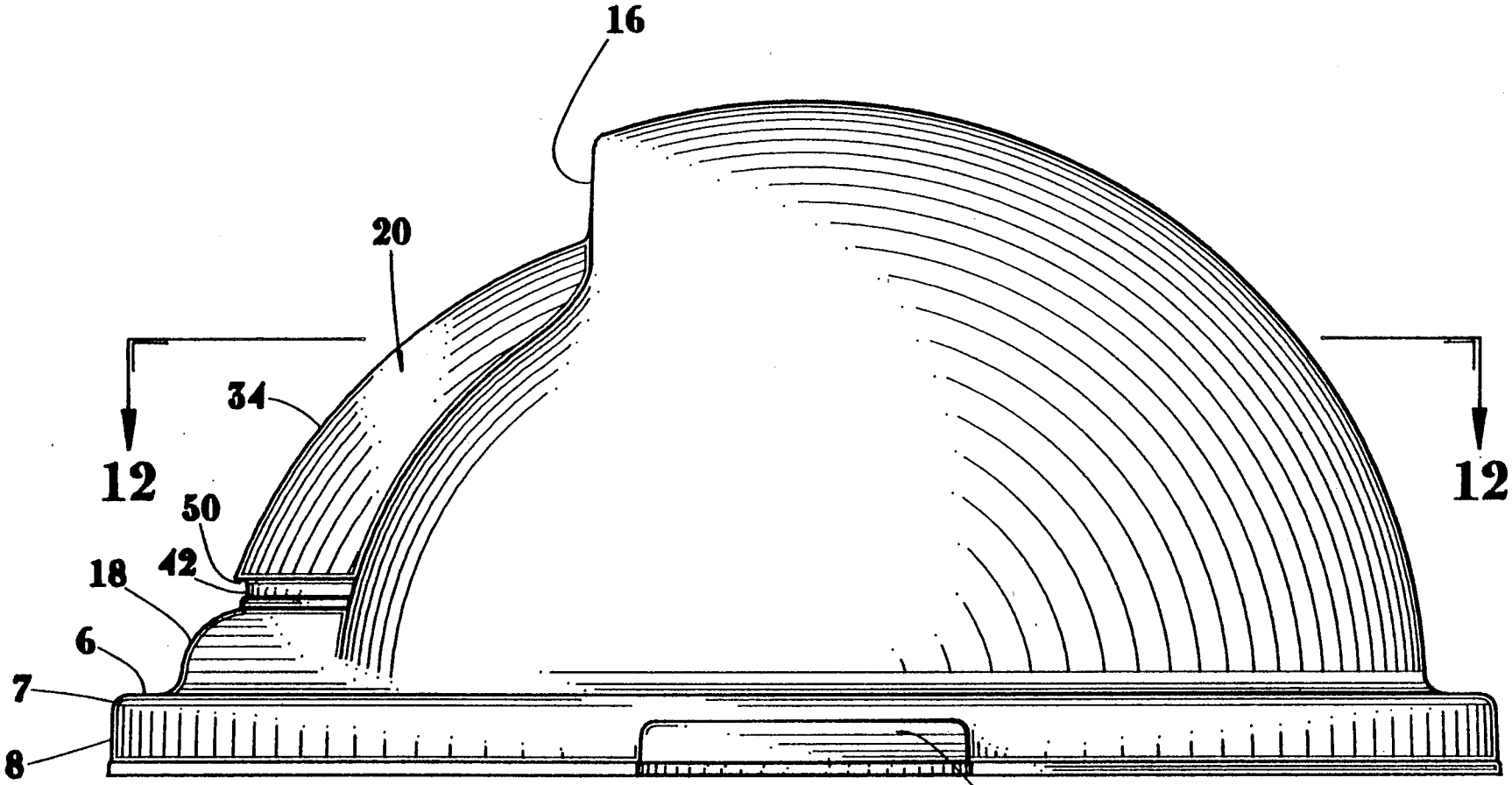

FIG. 7 is a side elevation view of the lid.

Figure 4:
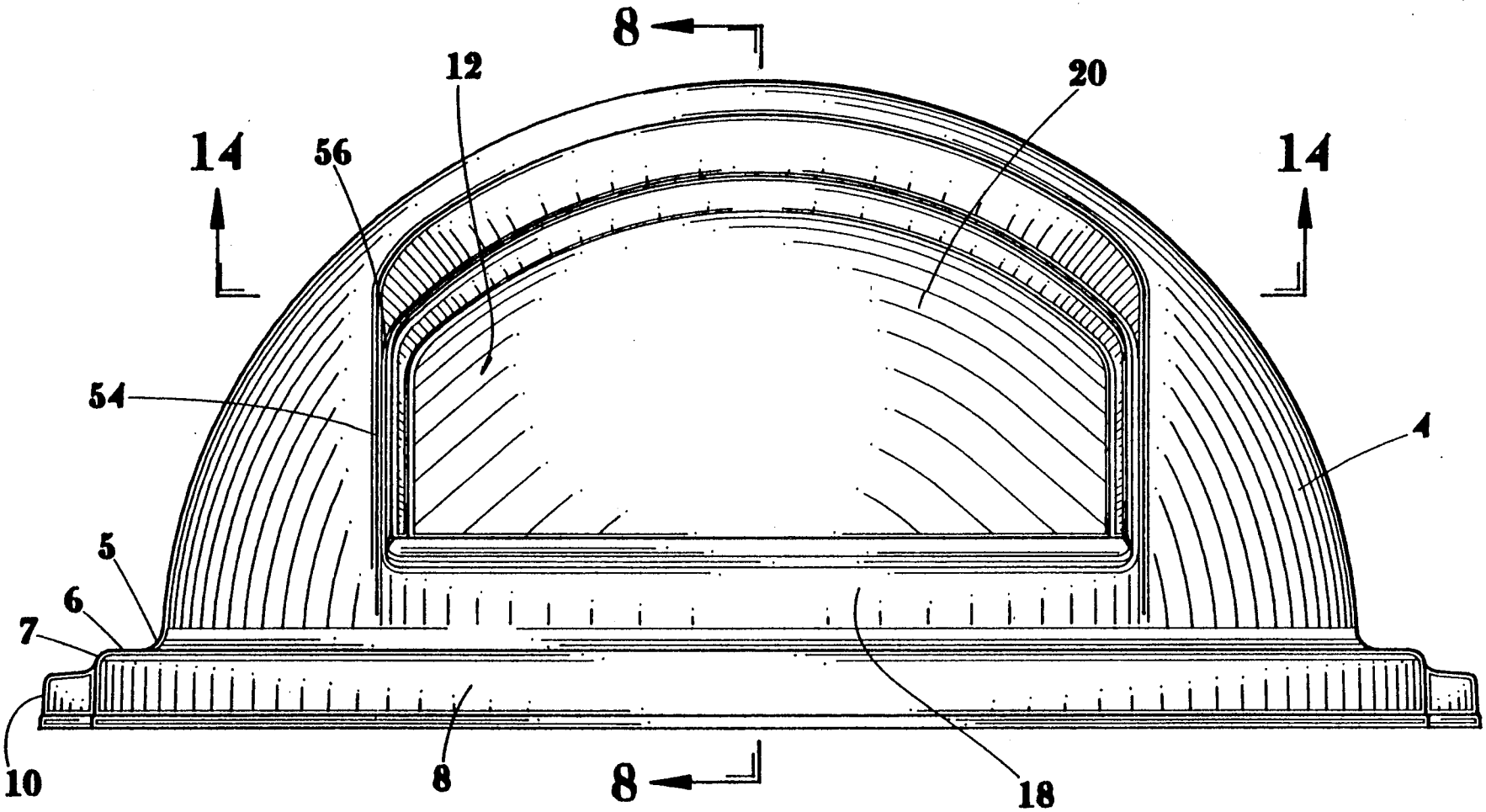
FIG. 4 is front elevational view of the lid.
Figure 8:
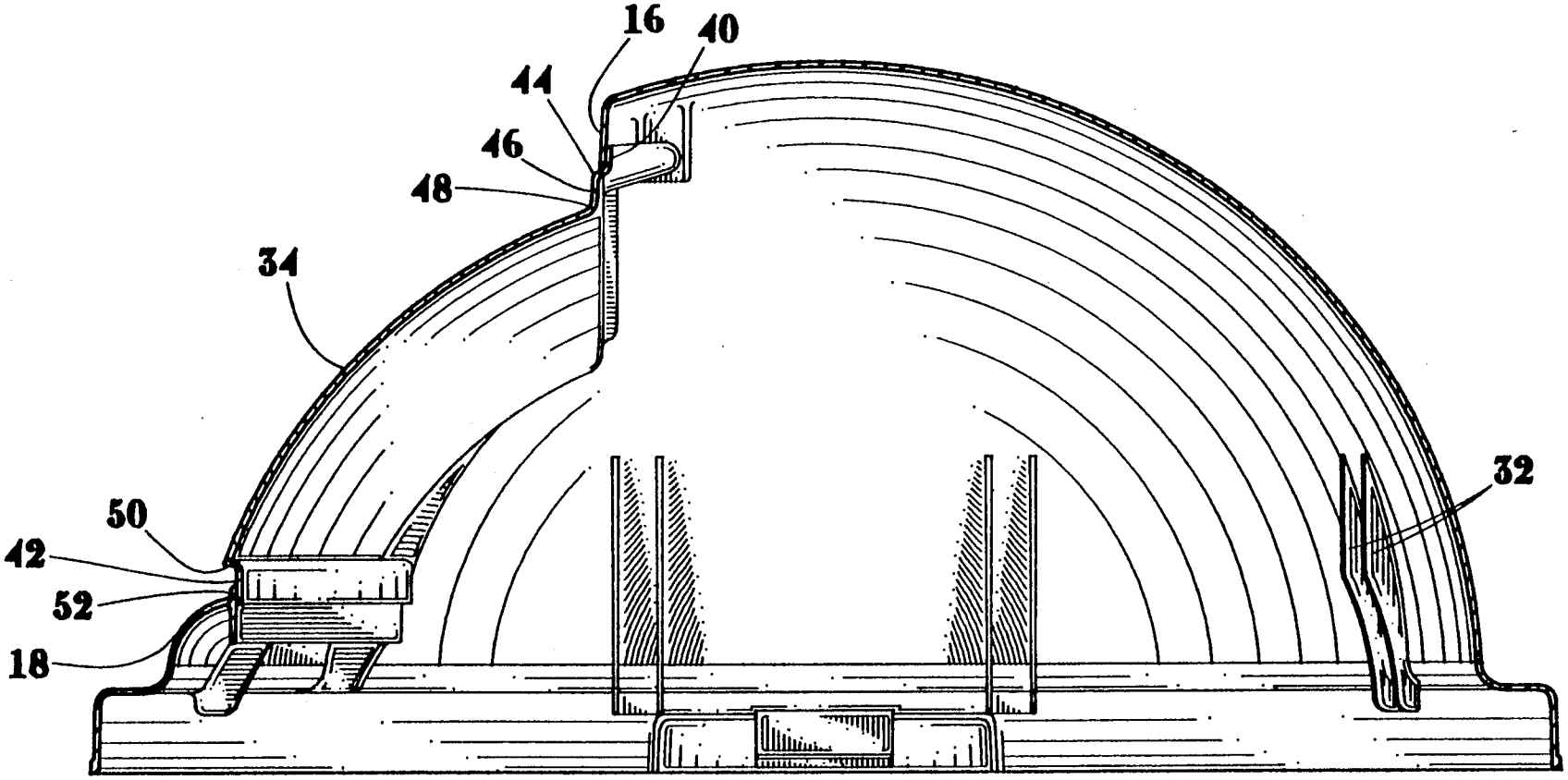

FIG. 8 is a longitudinal section view through the lid, taken along the line 8—8 of FIG. 4.

Figure 9:
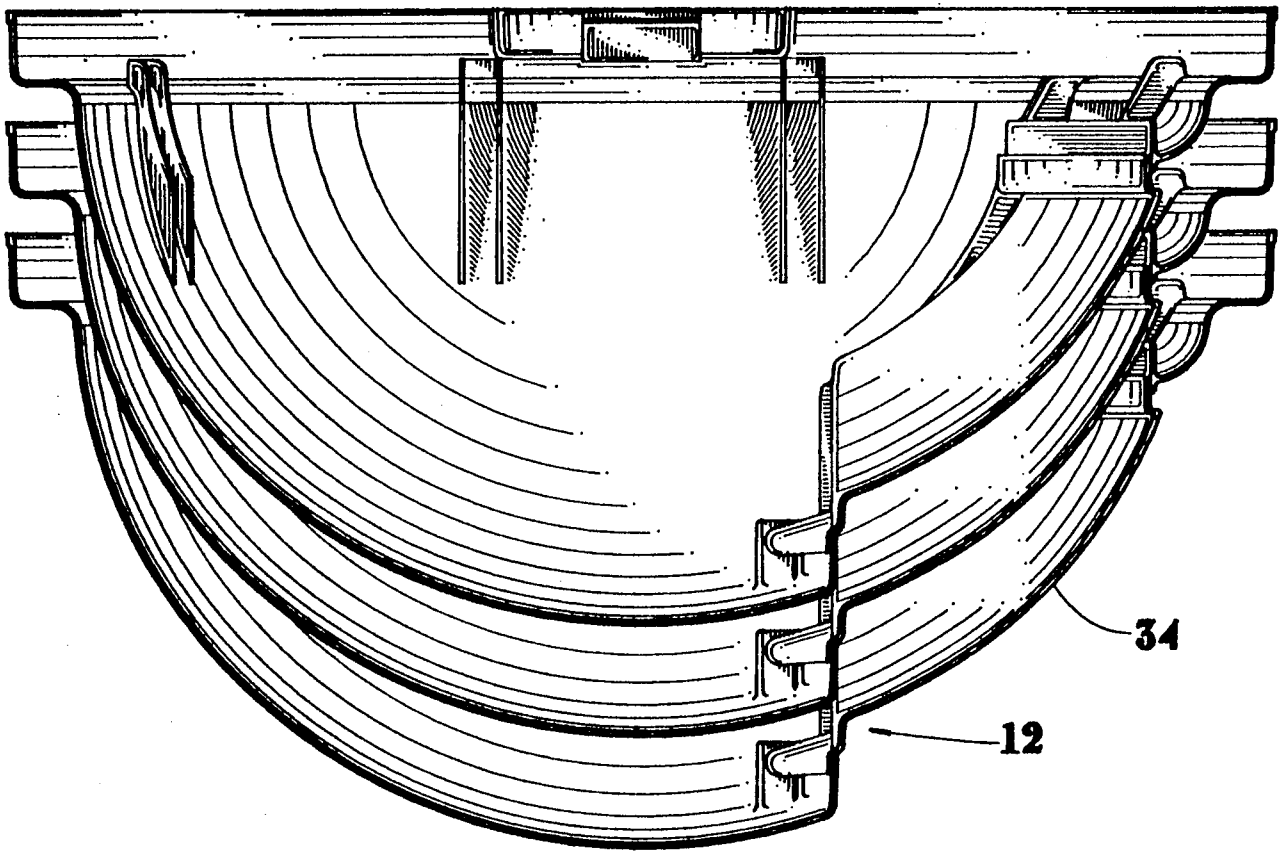

FIG. 9 is a section view through a stack of nested lids, each lid shown as taken along the line 9—9 of FIG. 6.

Figure 10:
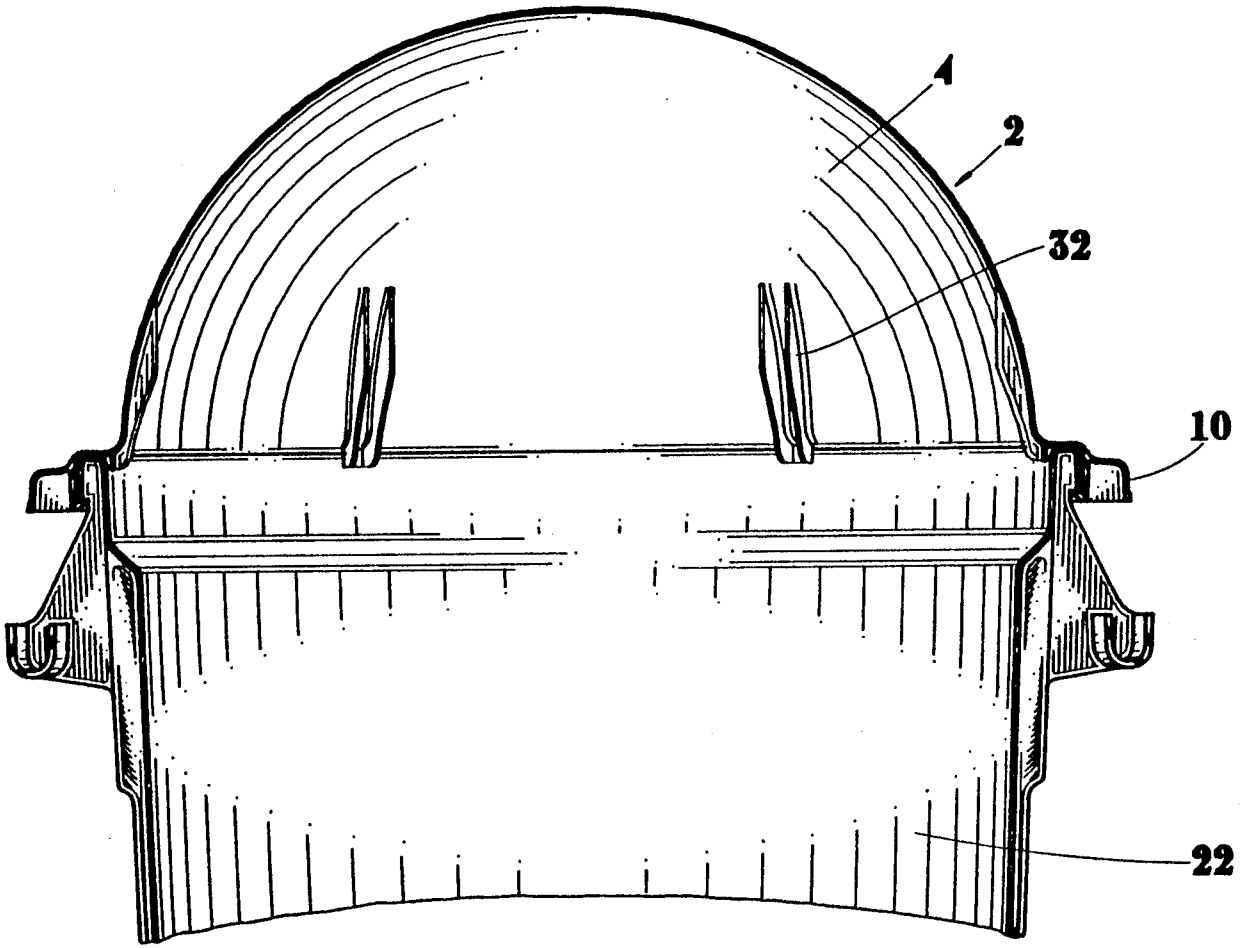

FIG. 10 is a transverse section view of the lid on a receptacle, the lid as taken along line 10—10 of FIG. 5.

Figure 11:
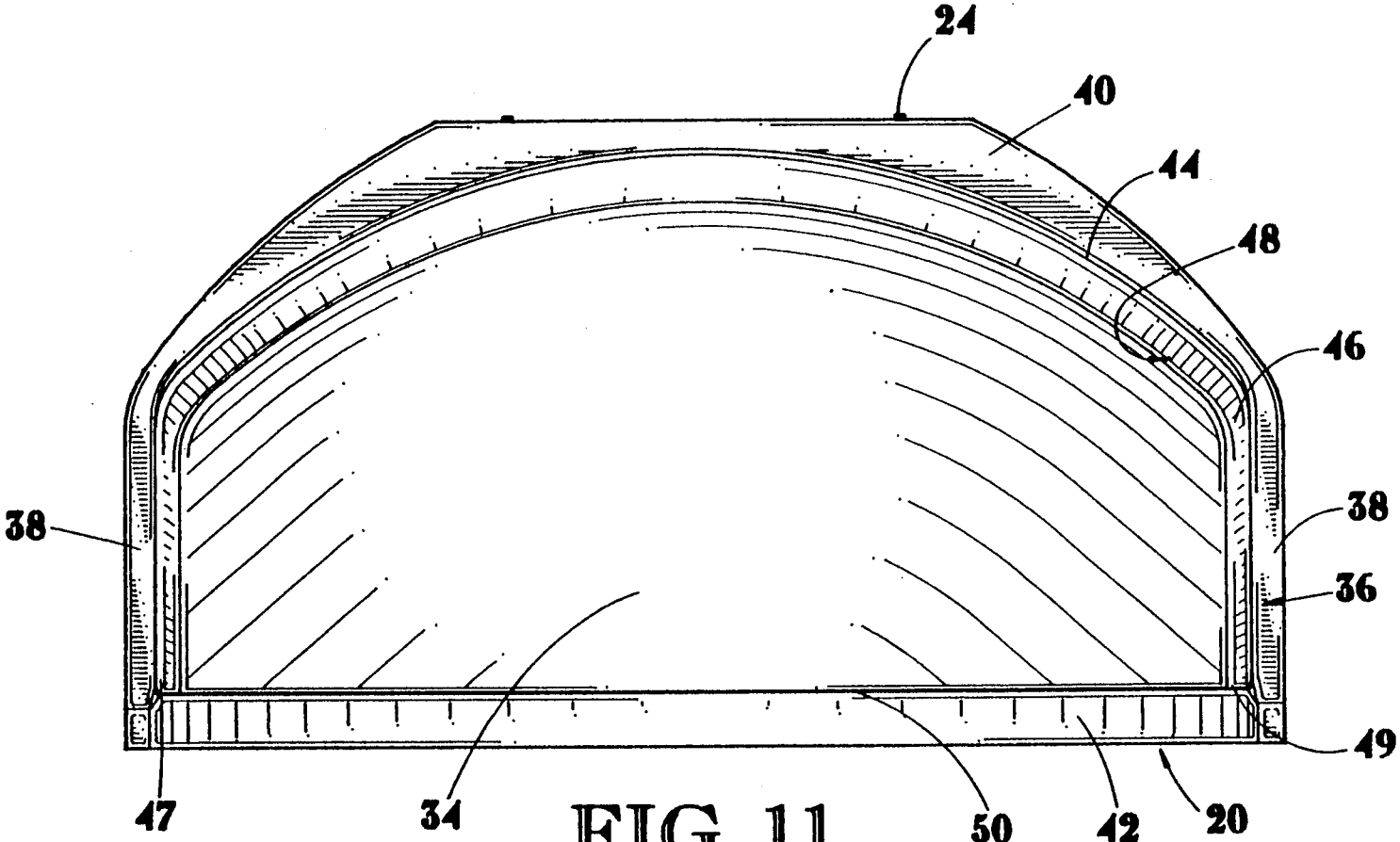

FIG. 11 is a front plan view of the door component of the lid.

Figure 12:
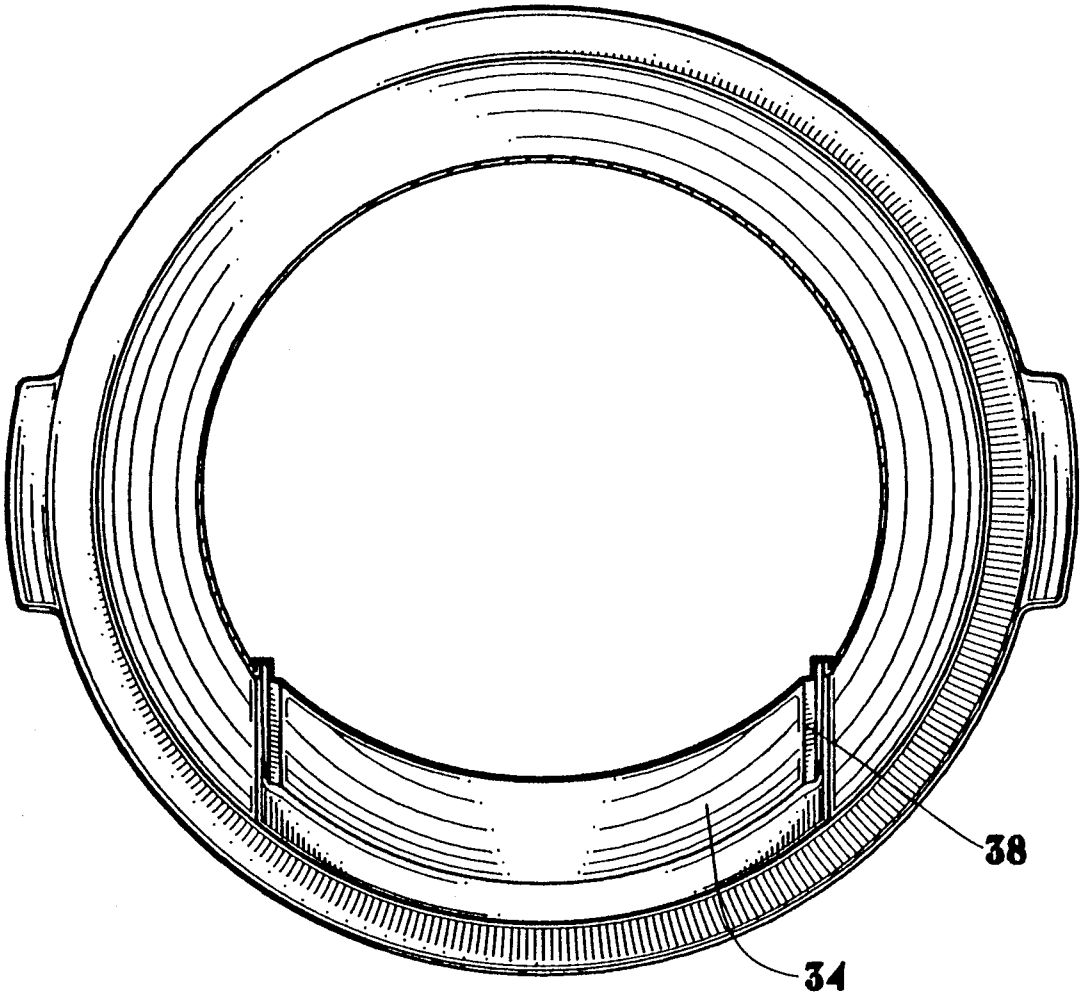

FIG. 12 is a transverse section view of the lid taken along 12—12 of FIG. 7.

Figure 13:
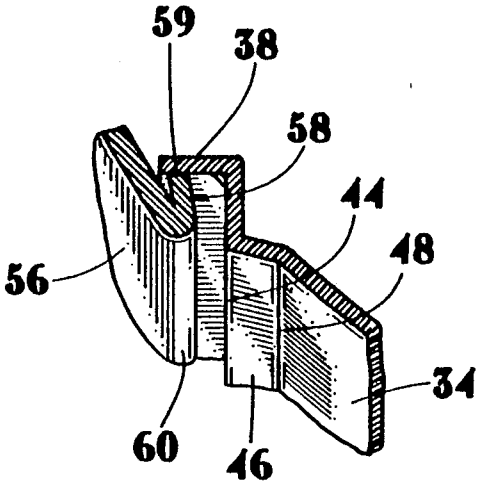

FIG. 13 is a fragmentary perspective view of a portion of the lid recess lateral sidewall and the door edge portion positioned there against.

Figure 14:
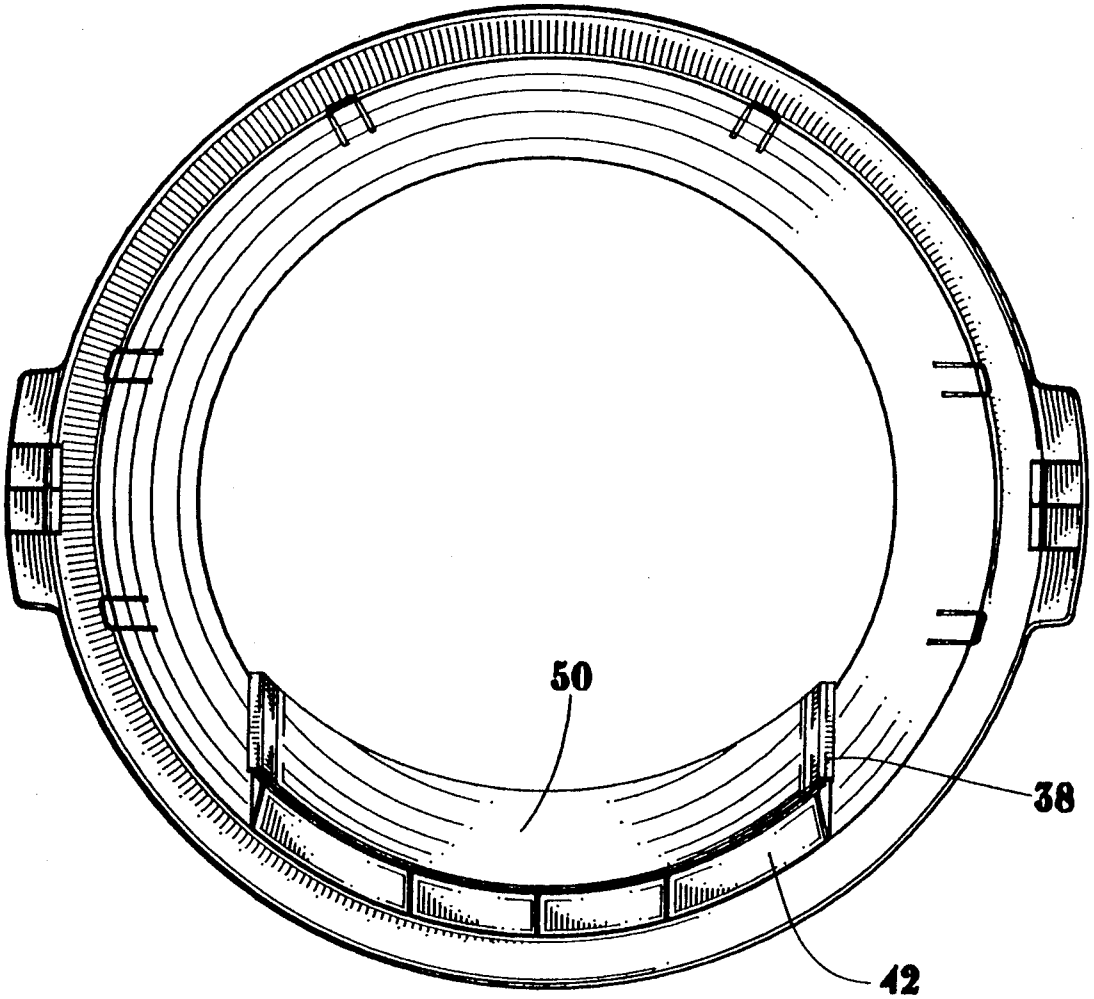

FIG. 14 is transverse section view of the lid taken along line 14—14 of FIG. 4.

DESCRIPTION OF THE PREFERRED EMBODIMENT

Referring first to FIGS. 1, 3, 4 and 5, the domed lid 2 comprising the invention is shown to comprise an outer domed surface 4, intersecting at a lower trough 5 a bottom step 6, which in turn merges by way of shoulder 7 into downturned rim 8. The lid body is injection molded of commercial grade plastic by conventional means.

Figure 1:
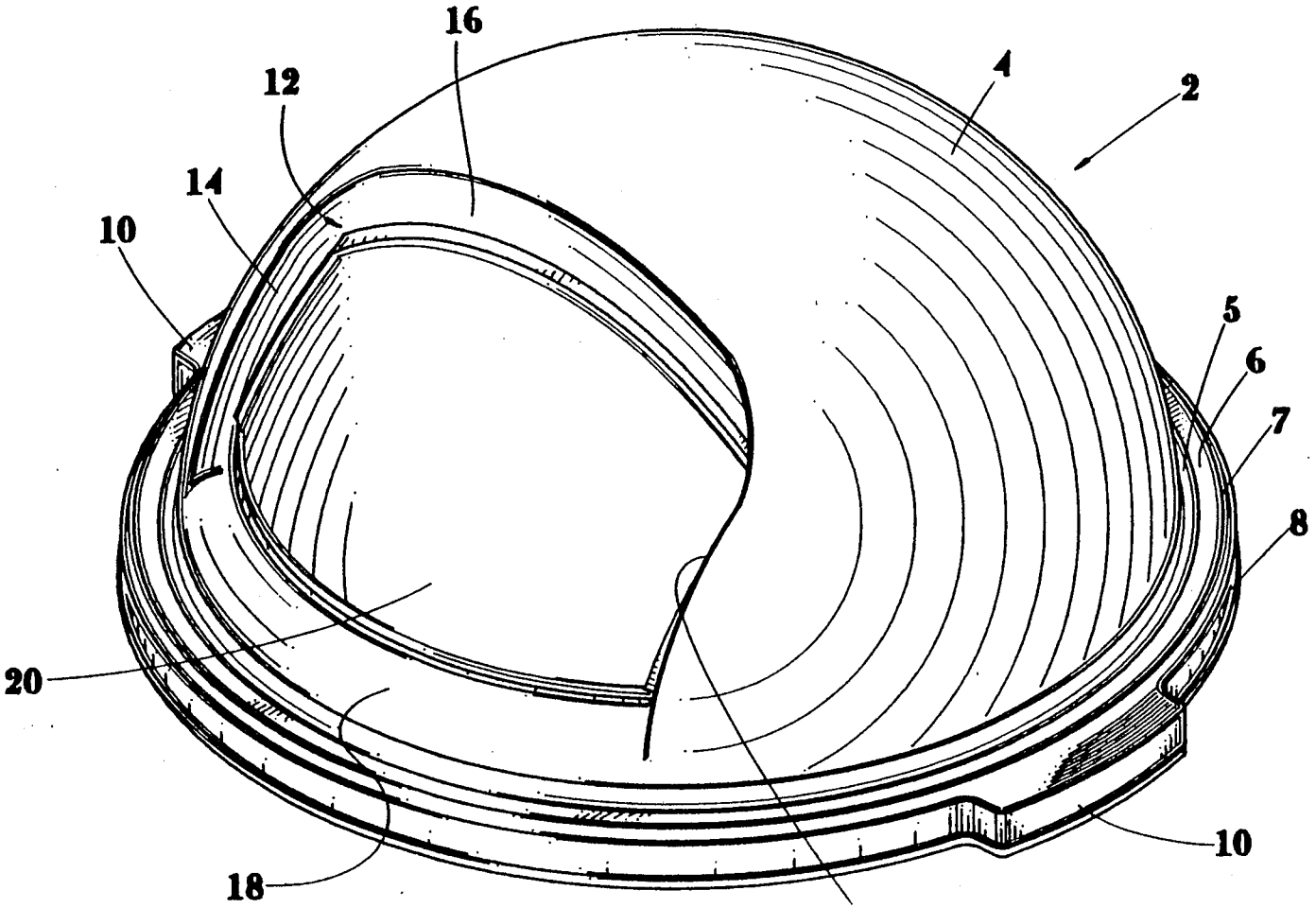
FIG. 1 is front perspective view of the waste receptacle lid comprising the invention.

A pair of handles 10 are integrally formed to the lower rim 8 as shown. A generally quadrilateral frontal recess 12 is formed into the surface 4, defined by lateral recess sidewalls 14, top recess wall 16, and a lower recess defining sidewall 18. The lateral sidewalls are inwardly and downwardly canted toward the recess opening, as seen in FIGS. 1, 4 and 13; the top sidewall 16 is substantially vertical in orientation as seen from FIG. 8, and the bottom or lower sidewall 18 is outwardly concave and radiused, extending from the recess opening downward to the lower lid rim 8.

Figure 2:
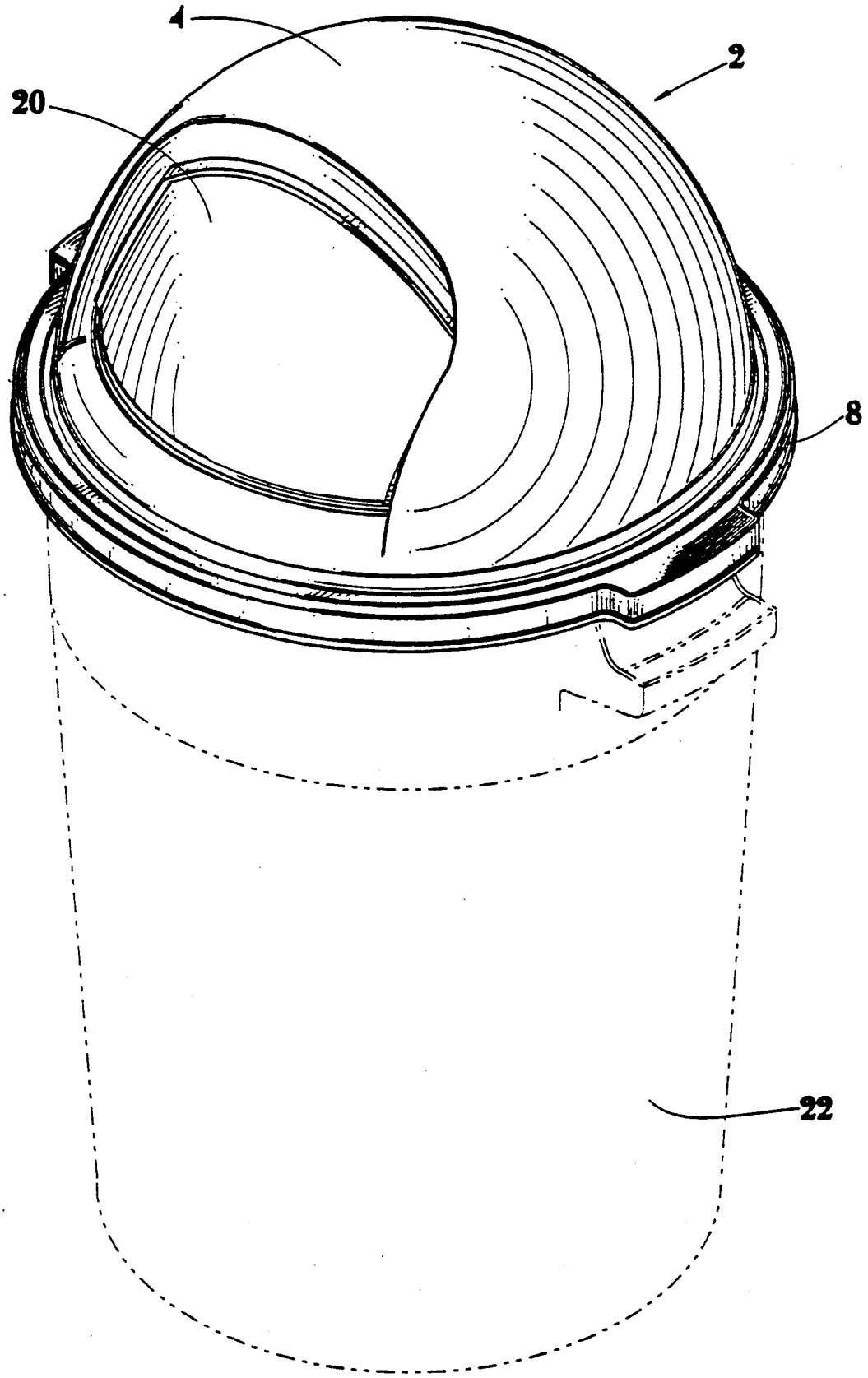
FIG. 2 is a front perspective view of the lid shown in position on a receptacle base.
Figure 3:
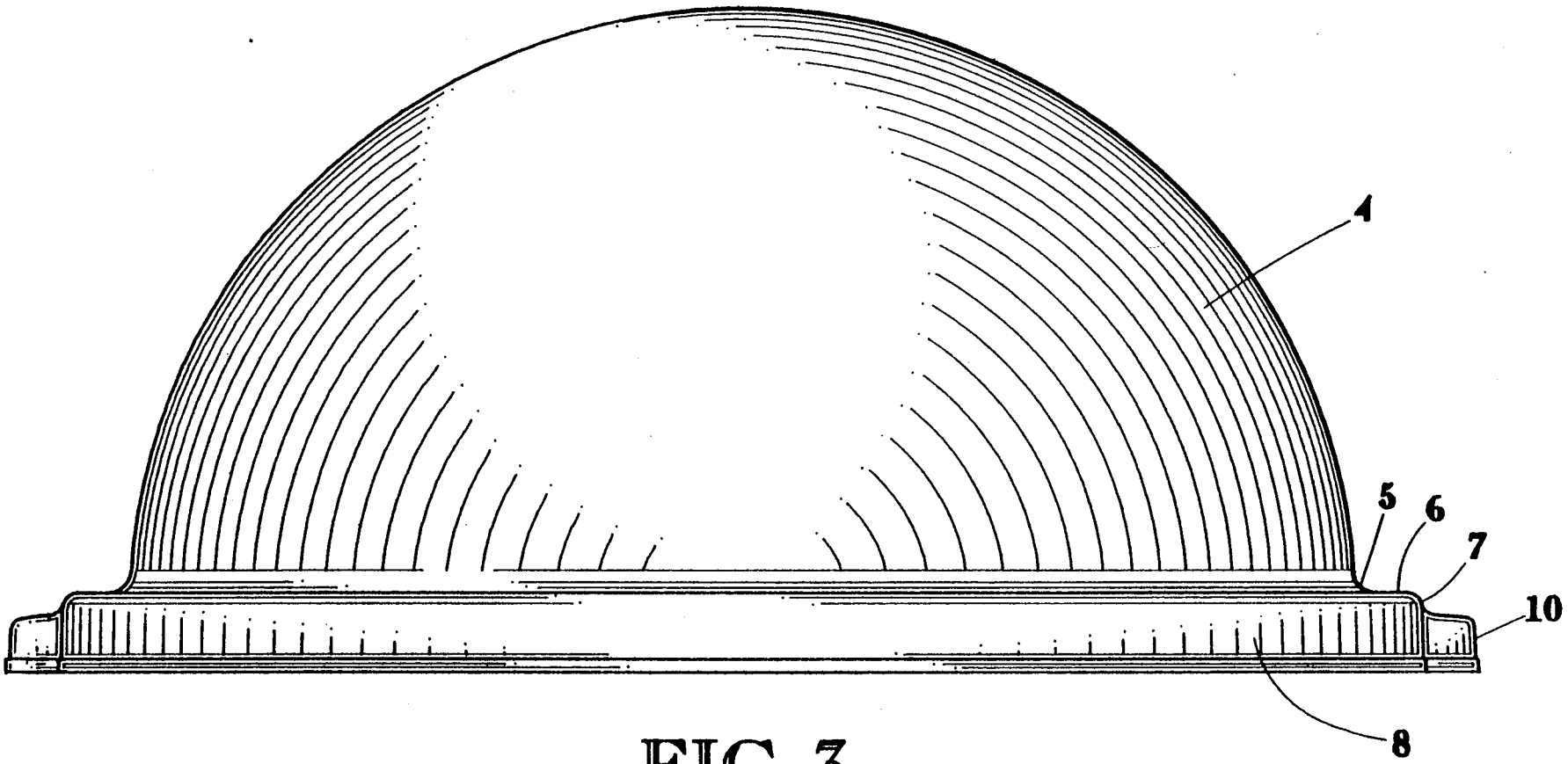
FIG. 3 is a rear elevational view of the lid.

A hinged door 20 is mounted within the recess 12, and pivots inward to expose the recess opening and outward to close the recess opening. As depicted in FIG. 2, the lid 2 fits upon a receptacle 22, with the downward rim flange 8 of the lid fitting over the upper rim (not shown) of the receptacle 22. It will be appreciated that the lid, when used out of doors, will shed rain water striking surface downwardly over the lower rim 8 and off, whereby protecting the receptacle contents from the water. The door 20 is normally closed and is opened by users in conventional manner.

Referring to FIG. 6, showing the interior of the lid, it will be appreciated that a pair of L-shaped pivot posts 24 are integrally molded to the rearward side of door 20, and include remote pivot segments 26 which protrude through anchoring brackets 28 in conventional fashion. A helical torsion spring 30 encircles the pivot segments 26, with an end of the spring 30 abutting the internal side of the door 20. As the door pivots open, the spring 30 coils tightly and, upon release of the door, the spring releases to force the door back into its closed position. Spaced around the circumferential interior of the lid are reinforcement flanges 32 as seen from FIGS. 6 and 8, which add structural integrity to the domed lid.

Referring to FIGS. 7, 8 and 11, it is shown that the pivot door 20 is domed in side profile, having an outwardly concave central surface 34 surrounded by an edge flange border 36. Border 36 comprises side flanges portions 38, a rearward (top as viewed in FIG. 11) flange portion 40, and a forward flange portion 42. A raised ridge 44 extends about the periphery of the door 20 between the flange portions 30 and 40 and the central surface 34 of the door.

The ridge 44 is peaked, and is defined along an inward side by sloped surface 46. So positioned, the surface 46 of the ridge 44 and the outward terminal edge of the domed central surface 46 define a peripheral trough 48 extending about the peripheral sides and top of the door, and having trough ends 47,49 which are located above the forward flange portion 42 of the lid door.

From FIGS. 7 and 8, it will be seen that the domed surface 34 of the door 20 has a forward edge lip 50 which overhangs the forward flange portion 42. With the door in its closed position as shown, the forward flange portion 42 abuts an upward lip 52 of the radiused shoulder 18, biased thereagainst by the spring mechanism previously described. The domed central surface 34 catches rainwater and directs it over the forward lip 50 and onto the shoulder 18. The bias of surface 42 against the upward lip 52 prevents the rainwater from traveling between those surfaces and gaining access to the interior of the lid. The rainwater, after contacting shoulder 18, is directed therealong downward to the bottom step 6, over the shoulder 7, and off the downturned rim 8. Accordingly, the rainwater does not enter the lid and cannot wet the contents of the receptacle therebelow. The positive bias of the door and lid internal surface of lip 52 ensures that the door will swing promptly closed after use, regaining its water deterring relationship with the surrounding lid internal surfaces.

Referring to FIGS. 4 and 13, it will be seen that the side portion 54 defining the recess 12 is beveled inwardly and down into the recess, with a lower sloped portion 56 having a lower terminal reversely formed portion 58. The side flange portion 38 of the door abuts an inward edge 59 of the hood reversely formed portion 58, biased thereagainst by the spring mechanism described above. The lowermost end 60 of the inward sloping side portion 56 overhangs the raised ridge 44, such that water running down the side portion 56 defining the recess 12 will drop from the end 60 and into the trough 48 of the door. The trough, defined between an inward sloped side 46 of the ridge and the outer edge of the domed central surface 34 of the door, has ends (47, 49 shown in FIG. 11) which overhang the shoulder 18. Accordingly, rain which runs down the trough 48 of the door will follow a downward path and exit onto shoulder 18, from where it will proceed to the lower lid rim as described above.

From the above, it will be appreciated that the rainwater which enters the recess 12 is either intercepted by the lid side portions 54 and channeled into the door trough 48, or will engage directly against the door. In either case, the rainwater is channeled downward over the domed door and onto the forward lid shoulder 18. Because the shoulder is outwardly concave and extends in a downward direction, the rainwater proceeds undeterred to and then off the lower rim of the lid.

It will further be appreciated that the door flange portion 38 abuts against the edge 59 of the reversely formed portion 58 of the lid, acting as a deterrent to any rainwater which might seek to find its way into the lid between sides of the door and the lid. The spring mechanism previously describes positively biases the abutting surfaces together to enhance the seal created thereby.

From FIG. 8, it will be seen that the top flange portion 40 likewise engages against an inward surface of the lid recess wall 16. Rainwater which runs along the wall 16 is directed over the ridge 44 and into the trough 48. Because the wall 16 is essentially vertical, as is the orientation of the flange portion 40 thereagainst, this will readily occur. Moreover, the sides of the ridge 44 extend in a vertical direction as shown, which ensures that the rainwater will in undeterred fashion run over the ridge 44 and into the trough 48. The spring mechanism biases the flange portion 40 against an inward surface of the recess wall 16 such that rainwater, which impacts that intersection, is unlikely to penetrate therethrough and into the interior of the lid.

FIG. 9 illustrates a nested inverted stack of lids produced pursuant to the subject teaching. It will be noted that the relatively shallow recess 12, and the outward domed shape of the door surface 34, make the door structure's intrusion into the interior of the lid minimal. Accordingly, the lids may be nested together in a compact stack, making their shipment more economical. In contrast, lids which have a right angle recess formed therein and a vertical door will not nest together in a compact stack. The domed lid door complements the domed shape of the lid body, making the lid appear to have a continuously domed appearance as well.

The door and lid body are conventionally moldable of plastics material. The torsion spring is of a commodity type. The three components of the assembly are therefore economical to manufacture and assembly, making the resultant lid economically viable. By channeling water away from the intersecting surfaces of the door and lid, because of the water deterring abutment of the door edge portions with internal surfaces of the lid body, the lid provides a rain resistant cover for a refuse container yet readily enables a user to dispose of trash through the lid door.

While the above describes the preferred embodiment of the subject invention, the invention is not to be so limited. Other embodiments which utilized the teachings herein set forth are intended to be within the scope and spirit of the invention.

We claim:

1. A lid for a refuse container, comprising:

a lid body having a domed outer surface extending from a top to a lower rim which is shaped and dimensioned to rest over an upper rim of a receptacle;

said domed surface having a frontal recess formed therein defined by top, lateral and bottom sidewalls and said recess terminating at an inward opening;

a door positioned within the recess and covering the opening, said door being pivotally attached to the lid body to selectively open and close the lid body opening;

said door having a domed central surface and outer edge flange portions bordering top, lateral and bottom door sides, and said door further having raised ridge means positioned between said top and lateral edge flange portions and said central domed surface, said ridge means being positioned such that water run-off from the top and lateral recess sidewalls is intercepted by the ridge means and directed toward the domed central lid portion.

2. A lid according to claim 1, wherein an inward surface of said ridge means and said domed central lid portion meeting to form a drainage channel extending substantially along said lateral and top door sides and have remote channel ends which extend forward and downward to a position above said recess bottom sidewall, whereby said water run-off is collected in said channel and discharged upon said recess bottom sidewall.

3. A lid according to claim 2, wherein said recess bottom sidewall has an outward and downward curvature for directing said water run-off discharged thereover to said lid lower rim.

4. A lid according to claim 3, wherein said lid domed central portion has a lower edge disposed above said recess bottom sidewall, whereby water traveling over said domed central portion is discharged upon said bottom recess sidewall.

5. A lid according to claim 4, wherein said recess lateral sidewalls slope inward and downward toward said door, and have remote edge portions which overhang said ridge means.

6. A lid according to claim 5, wherein said door edge flange portions engage against correspondingly located internal surfaces of said lid surrounding said opening, and said door having means for biasing said door edge flange portions against said internal surfaces, whereby deterring the entry of water between said flange portions and said internal surfaces.

7. A lid according to claim 6, wherein said recess top sidewall and said door top edge flange portion extend in a vertical and parallel mutual orientation.

8. A lid according to claim 7, wherein said recess lateral sidewall remote edge portions have reverse bends formed therein, and free end edges of said edge portions extend inward and a door edge flange portion abuts against said free end edges.

9. A lid for a refuse container, comprising:

a lid body having a domed outer surface which extends from a top to a lower rim and which is shaped and dimensioned to rest over an upper rim of a receptacle;

said domed surface having a frontal recess formed therein which is defined by top, lateral, and bottom sidewalls and which terminates at an inward opening;

a door having a domed central surface and outer edge flange portions along top and lateral door sides, said door having collective channel means defined along said top and lateral door sides for collecting water from said recess top and lateral sidewalls, directing the water forwardly, and there discharging the water over said recess bottom sidewall.

10. A lid according to claim 9, wherein said door edge flange portions engage against correspondingly located internal lid surfaces substantially surrounding said opening, and said door having means for biasing said door edge flange portions against said internal surfaces, whereby deterring the entry of water between said flange portions and said internal surfaces.

11. A lid according to claim 9, wherein said collective channel means comprise raised ridge means positioned between said top and lateral edge flange portions and said central domed surface of said door, said ridge means positioned such that water run-off from the top and lateral recess sidewalls is intercepted by the ridge means and directed toward the central lid portion.

12. A lid according to claim 11, wherein said recess lateral sidewalls slope inward and downward toward said door and have remote edge portions which overhang said ridge means.

13. A lid according to claim 12, wherein an inward surface of said ridge means and said domed central lid surface meeting to form a drainage channel extending substantially along said top and lateral door sides and having remote channel ends extending forward and downward to a position above said recess bottom sidewall.

14. A lid according to claim 13, wherein said recess bottom sidewall extends downward toward said lid lower rim.

15. A lid according to claim 14, wherein said domed central lid portion has a lower edge disposed above said recess bottom sidewall, whereby water traveling over said domed central portion is discharged upon said bottom recess sidewall.

16. A lid according to claim 15, wherein door edge flange portions engage against correspondingly located internal surfaces of said lid substantially surrounding said opening, and said door having means for biasing said door edge flange portions against said internal surfaces, whereby deterring the entry of water between said flange portions and said internal surfaces.

17. A lid according to claim 14, wherein said recess bottom sidewall having an outwardly domed profile, whereby water discharged thereover is directed downward to said lid lower rim.

18. A lid for a refuse container, comprising:

a lid body having a domed outer surface which extends from a top to a lower rim and which is shaped and dimensioned to rest over an upper rim of a receptacle;

the domed surface having a frontal recess formed therein which is defined by top, lateral, and bottom sidewalls and which terminates at an inward opening;

the recess bottom sidewall having water directing means which extends from the recess opening toward the lid lower rim;

a door having a central surface and outer edge flange portions along top and lateral door sides, the door having collective channel means which is defined along the top and lateral door sides between the edge flange portions and the central door surface and which is situated below inwardmost extending portions of the recess top and lateral sidewalls for collecting water from the recess top and lateral sidewalls, directing the water downwardly of the lid, and there discharging the collected water upon the recess bottom sidewall water directing means.

19. A lid according to claim 18, wherein the recess bottom sidewall water directing means comprises a bottom sidewall profile which extends outward and downward from the recess toward the lid lower rim.

20. A lid according to claim 19, wherein said collective channel means comprise raised ridge means, said ridge means positioned to receive water run-off from the top and lateral recess sidewalls and to direct the water run-off downward to said recess bottom sidewall.

21. A lid according to claim 20, wherein said door central surface is outwardly domed.

22. A lid according to claim 21, wherein said ridge means and said domed central lid surface meeting to form a drainage channel extending substantially along said top and lateral door sides and having remote channel ends extending forward and downward to a position above said recess bottom sidewall.

23. A lid according to claim 22, wherein recess lateral sidewalls slope inward and downward toward said door and have remote edge portions which overhang said ridge means.

24. A lid according to claim 23, wherein said door edge flange portions engage against correspondingly located internal surfaces of said lid surrounding said opening, and said door having means for biasing said door edge flange portions against said internal surfaces, whereby deterring the entry of water between said flange portions and said internal surfaces.

* * * * *